US008834253B2

(12) United States Patent
Tarantino

(10) Patent No.: US 8,834,253 B2
(45) Date of Patent: Sep. 16, 2014

(54) GAMING DEVICES HAVING PLAYER ASSIGNED RANDOM NUMBER GENERATORS AND TIME SHARE FEATURE

(76) Inventor: Elia Rocco Tarantino, Las Vegas, NV (US)

( * ) Notice: Subject to any disclaimer, the term of this patent is extended or adjusted under 35 U.S.C. 154(b) by 311 days.

(21) Appl. No.: 13/207,285

(22) Filed: Aug. 10, 2011

(65) Prior Publication Data

US 2013/0040728 A1 Feb. 14, 2013

(51) Int. Cl.
*G07F 17/32* (2006.01)

(52) U.S. Cl.
CPC ..... *G07F 17/3223* (2013.01); *G07F 17/3239* (2013.01); *G07F 17/3241* (2013.01); *G07F 17/323* (2013.01); *G07F 17/3225* (2013.01)
USPC ..... 463/20

(58) Field of Classification Search
USPC ..... 463/22
See application file for complete search history.

(56) References Cited

U.S. PATENT DOCUMENTS

| | | | |
|---|---|---|---|
| 4,365,810 | A | 12/1982 | Richardson |
| 4,848,771 | A | 7/1989 | Richardson |
| 5,007,649 | A | 4/1991 | Richardson |
| 5,851,149 | A | 12/1998 | Xidos et al. |
| 6,368,218 | B2 | 4/2002 | Angell, Jr. |
| 6,409,602 | B1 | 6/2002 | Wiltshire et al. |
| 6,652,378 | B2 | 11/2003 | Cannon et al. |
| 6,682,421 | B1 | 1/2004 | Rowe et al. |
| 6,846,238 | B2 | 1/2005 | Wells |
| 7,413,513 | B2 | 8/2008 | Nguyen et al. |
| 7,512,235 | B2 | 3/2009 | Multerer et al. |
| 7,588,495 | B2 | 9/2009 | Walker et al. |
| 7,699,703 | B2 | 4/2010 | Muir et al. |
| 7,727,060 | B2 | 6/2010 | Mills |
| 7,877,798 | B2 | 1/2011 | Saunders et al. |
| 2003/0032481 | A1 | 2/2003 | Pfeiffer et al. |
| 2005/0037838 | A1 | 2/2005 | Dunaevsky et al. |
| 2006/0287067 | A1 | 12/2006 | White et al. |
| 2008/0113807 | A1 | 5/2008 | Alderucci |

(Continued)

FOREIGN PATENT DOCUMENTS

| | | |
|---|---|---|
| WO | WO2012/125604 | 9/2012 |
| WO | WO2012/125630 | 9/2012 |

OTHER PUBLICATIONS

PCT "Notification of Transmittal of the International Search Report and the Written Opinion of the International Searching Authority, or the Declaration for PCT/US2012/028866," mailed Nov. 1, 2012.

(Continued)

*Primary Examiner* — Pierre E Elisca
(74) *Attorney, Agent, or Firm* — Weide & Miller, Ltd.

(57) ABSTRACT

Gaming machines utilize the output of random number generators (RNGs) in the presentation of games, wherein one or more of the RNGs is each assigned to a single player. Each uniquely assigned RNG is used to determine the outcome of the games played only by the assigned player, such as games presented by casino gaming machines or via remote or mobile devices. An RNG may also be stopped or paused and then restarted, whereby a sequence of random data remains continuous or contiguous relative to a number of games played, such as by the single player to which the RNG is assigned. Multiple players may also time-share a gaming machine in a manner whereby the gaming machine acts as a unique device to each player.

19 Claims, 3 Drawing Sheets

(56) References Cited

U.S. PATENT DOCUMENTS

| | | | | |
|---|---|---|---|---|
| 2008/0254897 | A1 | 10/2008 | Saunders et al. | |
| 2009/0088240 | A1 | 4/2009 | Saunders et al. | |
| 2009/0088257 | A1 | 4/2009 | Saunders et al. | |
| 2009/0093311 | A1 | 4/2009 | Saunders et al. | |
| 2009/0093312 | A1 | 4/2009 | Carlson | |
| 2010/0075743 | A1 | 3/2010 | Yoshizawa | |
| 2010/0216534 | A1 | 8/2010 | Peck et al. | |
| 2011/0117983 | A1* | 5/2011 | Lombardo | 463/16 |
| 2012/0015718 | A1* | 1/2012 | Lombardo | 463/25 |
| 2012/0122550 | A1* | 5/2012 | Johnson et al. | 463/22 |
| 2012/0276981 | A1* | 11/2012 | Weber et al. | 463/22 |
| 2014/0106873 | A1* | 4/2014 | Schneier et al. | 463/29 |

OTHER PUBLICATIONS

PCT "Notification of Transmittal of the International Search Report and the Written Opinion of the International Searching Authority, or the Declaration for PCT/US2012/028870." mailed Oct. 29. 2012.

PCT "Notification of Transmittal of the International Search Report and the Written Opinion of the International Searching Authority, or the Declaration for PCT/US2012/028917," mailed Nov. 1, 2012.

* cited by examiner

GAMING DEVICES HAVING PLAYER ASSIGNED RANDOM NUMBER GENERATORS AND TIME SHARE FEATURE

FIELD OF THE INVENTION

The present invention relates to methods and devices for presenting and playing games.

BACKGROUND OF THE INVENTION

Wager-based or "casino-style" gaming is extremely popular. This type of gaming has expanded from table games and mechanical slot machines offered in a few locations, to complex electronic gaming machines which offer a variety of games located at large casinos in many states and countries.

Originally, slot machines were mechanical devices. These slot machines included a plurality of physical spinning reels. The reels were configured to rotate and stop randomly, whereby winning and losing results were essentially random.

In the 1980s and later, electronic gaming machines were developed and became popular. These gaming machines are configured to generate random game results using an electronic controller. For example, relative to a slot machine, a randomized outcome is selected and a controller causes stepper motors to move physical reels into positions corresponding to the selected outcome. Such a principle is disclosed in U.S. Pat. No. 4,448,419 to Telnaes.

A similar principle has been applied to other gaming machines, such as those which present video poker games. In particular, these gaming machines are configured so that card values are randomly selected and a controller causes the image of each selected card to be displayed to a player (in similar fashion to the dealing of a random physical card from a deck or shoe of cards at a gaming table).

Players have become very accustomed to watching gaming devices for trends and outcomes. For example, a player who is playing a gaming machine which has yielded a number of wins may wish to continue playing the gaming machine while it is "hot." The player may believe that if they leave the gaming machine for a period of time, during that time another player will play the machine and receive a number of game wins, only to have the machine enter a period of losing results by the time the player returns. Likewise, a player who has received a sufficient number of losing results may believe that the machine is overdue for a winning result. That player may not wish to leave their machine after losing a large sum of money, only to have another player play the machine and win a large jackpot after only a few plays. In addition, if a player sees another player win large jackpot at a gaming machine, such as one associated with a very infrequent outcome, the player may not wish to play that machine for some time, believing that the probability of the machine triggering that some outcome is then very low.

This is a common principle to games such as IGT's MegaBucks®. This game pays a linked progressive jackpot when a combination of Megabucks symbols is received. However, the probability of that combination is relatively low. As a result, the jackpot, which starts at $10M, often grows quite large. As the jackpot grows, players sense that the "jackpot is overdue", meaning that statistically the jackpot is past the average hit frequency. As a result, as the jackpot gets large, more and more players play the game for a chance of winning the jackpot. However, once the jackpot has been hit by another player, many players will cease game play on the belief that the probability of their winning the jackpot is then very low.

SUMMARY OF THE INVENTION

Aspects of the invention comprise methods of playing and presenting games, and gaming machines and gaming systems configured to present games.

In one embodiment, a gaming machine or gaming system includes multiple random number generators (RNGs) which each generate a sequence of random data, such as numerical values, used to determine game outcomes. One or more of the RNGs is each assigned to a single player. Each uniquely assigned RNG is used to determine the outcome of the games played only by the assigned player, such as games presented by casino gaming machines or via remote or mobile devices.

In a gaming system, the RNGs may be implemented by a server. A plurality of gaming machines and/or game servers (such as to facilitate remote or mobile game play) are configured to access the RNGs of the RNG server.

A player may identify themselves, such as by inputting or providing player identification information. Such information may be associated with a player tracking system which identifies individual players and their assigned RNGs. Once a player is identified, a gaming machine or game server preferably utilizes the player's assigned RNG to present games to the player.

In accordance with the invention, an individual player may have a dedicated game RNG, whereby game results generated or determined by that RNG are unique to that player and are not shared by other players.

In another embodiment of the invention, an RNG may also be stopped or paused and then restarted. In one embodiment, the RNG may be stopped and restarted to cause a sequence of random data generated thereby to remain continuous or contiguous relative to a number of games presented to a player.

In a preferred embodiment, a RNG which is assigned to a player may be stopped and restarted. When the player stops playing a first game session, the assigned RNG stops or pauses. When the same player begins play of a second game session, the assigned RNG restarts. Preferably, the RNG stops at a first point in the data sequence and then restarts from the next point in the data sequence.

In accordance with yet another embodiment of the invention, a gaming machine or device may be shared by two or more players. In a preferred embodiment, the gaming machine or device may be utilized at different times by two or more players in a time-share configuration, and preferably in a manner that the gaming machine acts as a unique device to each player.

In one configuration, players may reserve time periods or intervals at one or more gaming machines. During a reserved time period, a gaming machine may be locked from play by other than the player securing the reserved time. The gaming machine may display information that it is reserved during a reserved time period (so long as the player with the reservation is not playing the machine). A player having a reservation may be required to identify themselves, such as by using a player tracking card or other identification, or by using an access code, in order to access the gaming machine during the reserved time. During non-reserved times, the gaming machine or device may be available for public play.

Reservations may be implemented by a reservation system, such as via a reservation or player tracking server linked to one or more gaming machines. A casino or other game operator may charge a player for a reservation, including varying the price depending upon various factors such as the time of day, length of reservation and/or particular gaming machine.

In a preferred embodiment, multiple players may play games via a single gaming device, but in a manner where the gaming device emulates or acts as a gaming device which is unique to each player. In particular, in one embodiment, during a reserved period of game play, games presented by the gaming machine to the player may be presented utilizing the player's assigned RNG. In this manner, different players may utilize the same gaming machine or device during different time periods, wherein each player's play is unique or independent from the other players' play by virtue of each player's games being generated via their uniquely assigned RNG.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention comprises gaming devices and gaming systems for presenting games. In general, one embodiment of the invention comprises gaming machines and a gaming system which utilizes player-assigned random number generators. In one embodiment, a unique random number generator is assigned to a single player. That random number generator is used to determine the outcome of the games played only by the assigned player.

In accordance with another embodiment of the invention, an RNG may be stopped or paused and then restarted, such as in relation to a player's stopping and re-starting of game play.

In accordance with yet another embodiment of the invention, a gaming machine or device may be shared by two or more players. In a preferred embodiment, the gaming machine or device may be utilized at different times by two or more players in a time-share configuration, and preferably in a manner that the gaming machine acts as a unique device to each player.

Figure 1:
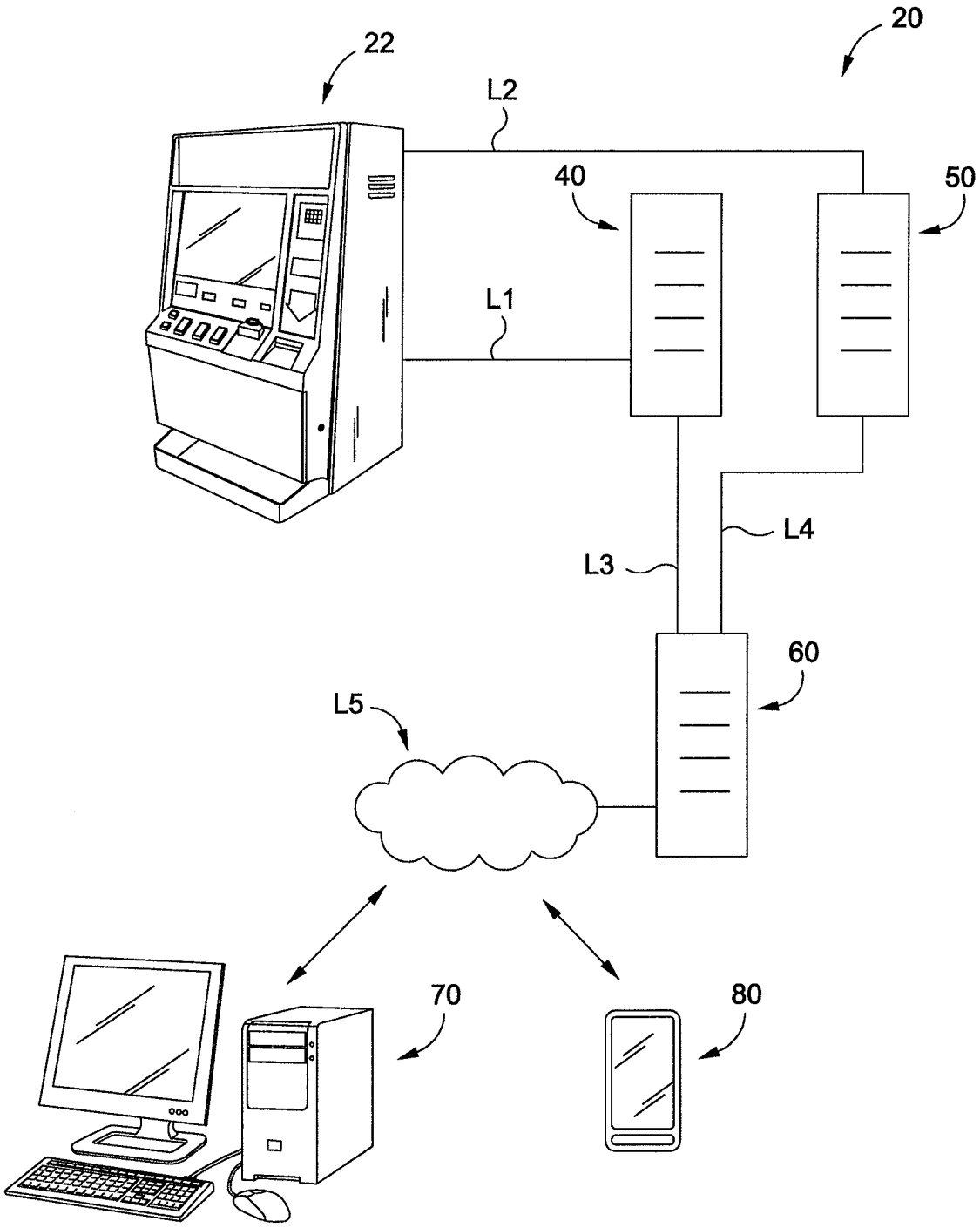
FIG. 1 illustrates one embodiment of a gaming system in accordance with the present invention.

One embodiment of a system of the invention will be described with reference to FIG. 1. FIG. 1 illustrates a gaming system 20. In one embodiment, the gaming system 20 includes a plurality of gaming machines or devices 22 (only one of which is illustrated in FIG. 1). The gaming machines 22 may be located, for example, on the floor of one or more casinos.

Figure 2:
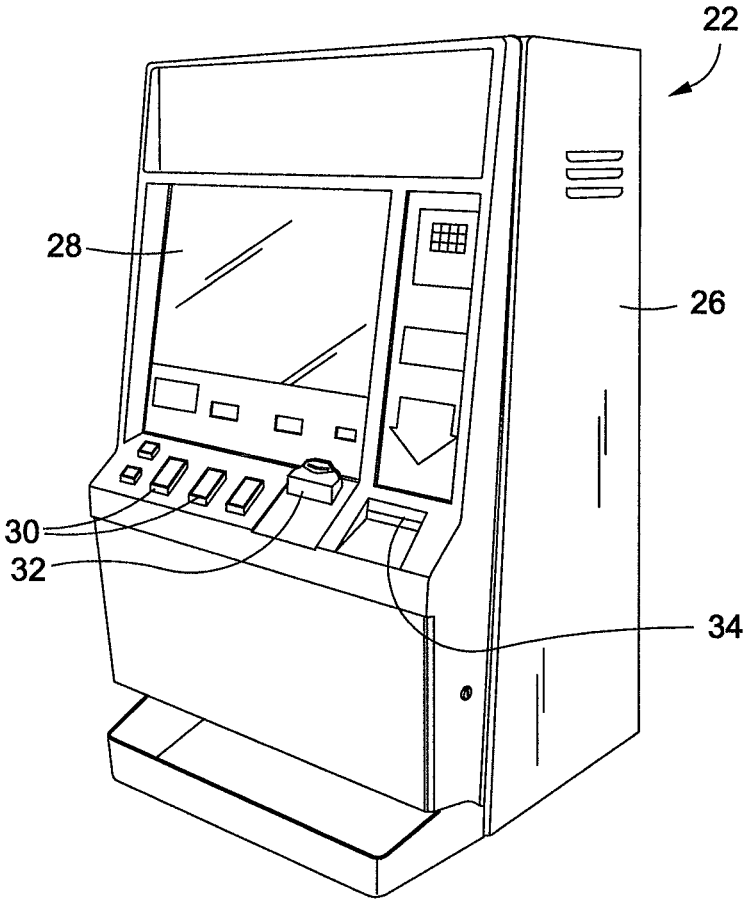
FIG. 2 illustrates in greater detail a gaming machine of the system illustrated in FIG. 1.

The gaming machines 22 may have various configurations. One configuration of a gaming machine is illustrated in FIG. 2. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one display device 28 configured to display game information. The display device 28 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display 28 may be capable of projecting or displaying a wide variety of information, including images, symbols and other indicia or information associated with game play, game promotion or other events. The display device 28 might alternatively, or in addition, comprise other devices. For example, if the gaming machine 22 is configured as a slot-type machine, the display device 28 might comprise one or more spinning reel devices.

As described in more detail below, the gaming machine 22 is preferably configured to present one or more games upon a player making a monetary payment or wager. In this regard, as described in more detail below, the gaming machine 22 includes means for accepting monetary value.

In one embodiment, certain game outcomes may be designated as winning outcomes. Prizes or awards may be provided for winning outcomes, such as monetary payments (or representations thereof, such as prize of credits), or promotional awards as detailed herein. As detailed below, the gaming machine 22 includes means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to "cash out" of the gaming machine, or to provide various other inputs.

In one preferred embodiment, the gaming machine 22 includes at least one microprocessor or controller for controlling the gaming machine, including receiving player input and sending output signals for controlling the various components of the machine 22 (such as generating game information for display by the display 28). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the at least one display 28 and for displaying information regarding awards for winning game outcomes, among other things.

The controller may be configured to execute machine readable code or "software" or otherwise process information, such as obtained from a remote server. Software or other instructions may be stored on a memory or data storage device. The memory may also store other information, such as pay table information. The gaming machine 22 may also include one or more random number generators for generating random data, such as numbers, such as for use in selecting cards, reel positions or other game information or outcomes for presenting a game in a random fashion. As detailed below, however, at one or more times the gaming machine 22 may obtain RNG data from a remote RNG.

Preferably, the controller is configured to execute machine readable code or instructions which are configured to implement one or more methods of game play. The controller of the gaming machine 22 may be configured to detect a wager, such as a signal from a player's depressing of the "bet one" button. For example, if the gaming machine 22 is configured to present a video poker game, upon such an event and/or the player otherwise signaling the gaming machine to present the game, the controller may be configured to cause images of cards to be displayed on the at least one display 28. The controller may accept input from a player of one or more cards to be held or discarded via the one or more player input devices of the gaming machine 22. In the case of a slot game, the gaming machine 22 may cause slot symbols to be displayed on the at least one display 28 and/or cause physical reels of the gaming machine to spin.

The gaming machine 22 may be configured to generate and present games in a stand-alone manner or it may be in communication with one or more external devices at one or more times. For example, the gaming machine 22 may be configured as a server based device and obtain game code or game outcome information from a remote game server (in which event the gaming machine controller may receive game information from the server, such as game outcome information, and use that server-generated information to present the game at the gaming machine). In the case of a server-based system, game code may be provided by the server to the gaming machine controller for execution. In another embodiment, the server might execute the game code and simply transmit game results to the gaming machine controller, whereby the gaming machine controller simply displays the game results and receives player inputs.

As indicated, the gaming machine 22 is configured to present one or more wagering games. Thus, the gaming machines 22 is preferably configured to accept value, such as in the form of coins, tokens, paper currency or other elements or devices representing value such as monetary funds. For example, as illustrated in FIG. 2, the gaming machine 22 might include a coin acceptor 32 for accepting coins. Of course, associated coin reading/verifying devices and coin storage devices may be associated with the gaming machine 22 if it is configured to accept coins. Likewise, the gaming machine 22 might include a media reader 34. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22.

As indicated, in one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 22 dispensing coins to a coin tray. In another embodiment, funds may be issued by dispensing paper currency. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference.

It will be appreciated that the gaming machine illustrated in FIG. 2 is only exemplary of one embodiment of a gaming machine and device. For example, it is possible to for the gaming machine to have various other configurations, including different shapes and styles and having different components than as just described.

In one embodiment, the system 20 further comprises at least one random number generation ("RNG") device. In a preferred embodiment, the RNG device comprises a computing device such as a server 40. The RNG server 40 preferably comprises a device which is configured to generate random numbers or other random data. In a preferred embodiment, as detailed below, the RNG server 40 comprises multiple RNGs, wherein one or more of the RNGs is uniquely assigned to a specific player.

The system 20 may further comprise a player tracking server 50. The player tracking server 50 may comprise one or more computing devices. The player tracking server 50 may comprise at least one controller or processor, one or more data storage devices such as hard drives, flash drives, RAM, ROM, EPROM, or other types of data storage devices now known or later developed, and one or more communication interfaces. The server 50 is preferably configured to execute various instructions either embodied as hardware or embodied as computer readable code or "software" which is executed by a controller. The software may be stored on the associated memory or data storage devices, for example.

In one embodiment, the player tracking server 50 is configured to store information regarding one or more players and their game play and related information. A game player may enroll or sign up to join a player tracking club. The player may provide contact and identity information, such as their name, address and phone number. This information may be stored in one or more files associated with the player.

As detailed below, a player may identify themselves at a gaming machine 22 or other device. In one embodiment, the player might identify themselves via a biometric identifier such as a fingerprint, retinal scan or the like. The player might also identify themselves by a unique identifier such as a code (user identification code and/or password), such as by entering a user ID and password via a keypad or the like at the gaming machine. The player might alternatively be issued a player tracking card or FOB having associated identification information such as a player code. This information might be scanned or otherwise read from the card or FOB, such as by a reader located at the gaming machine 22.

The identifying information may be transmitted to the player tracking server 50 which compares it to stored information. When the player tracking server 50 locates a match, the player tracking server 50 may access the player information stored therewith, as detailed below.

In one embodiment, the gaming system 20 may be configured to permit remote or mobile game play. For example, the gaming system 20 may facilitate the presentation and play of one or more games at remote player computer 70 (which may comprise a home or work laptop, desktop or other computer), or a mobile communication device 80 such as a player's telephone, PDA, tablet or the like.

In one embodiment, the system 20 may include a game server 60. The game server 60 may comprise at least one controller or processor, one or more data storage devices such as hard drives, flash drives, RAM, ROM, EPROM, or other types of data storage devices now known or later developed, and one or more communication interfaces. The server 60 is preferably configured to execute various instructions either embodied as hardware or embodied as computer readable code or "software" which is executed by a controller. The software may be stored on the associated memory or data storage devices, for example.

In one embodiment, the server 60 is configured to either transmit game code to a remote location, execute game code and transmit game data or results to a remote location, or both, whereby a game may be presented to a user at a remote location, such as a player's computer 70 or mobile device 80. For example, the server 60 may execute game code to implement a video poker game and then transmit game data such as data representing images of cards to the player's remote or mobile device. In another embodiment, the server 60 might transmit game code to the player's remote or mobile device for execution by that device, wherein the game data is generated at the remote or mobile device. The server 60 may be configured to service one or more players, and there may be more than one such server 60.

Preferably the various components of the system 20 may be linked via one or more communication links. The communication links may be wired and/or wireless and may include private and/or public aspects and local and/or wide area networks. In one embodiment, the links and/or the manner of communication may be secure, such as by having the links be dedicated and/or by encoding or encrypting the exchanged information in order to prevent its interception and/or tampering.

For example, the gaming machines 22 may communicate with the RNG server 40 and player tracking server 50 by one or more communication links L1 and L2. The game server 60 may communicate with the RNG server 40 and player tracking server 50 by one or more communication links L3 and L4. The game server 60 may communicate with a player's computer 70 or mobile device 80 by one or more communication links L5. Such a communication link L5 may comprise, for example, the Internet. In order to facilitate these communication links, the various devices of the system 20 may include communication interfaces.

Of course, the system 20 might include various other features or components. For example, the system 20 might include an accounting server and associated components, as is well known in the art of gaming systems. The system 20 might also include various communication gateways, such as website servers via which a player may gain access to the system 20.

In accordance with the invention, one or more players are assigned their own RNG. In a further preferred embodiment, a player's RNG may be stopped and restarted, preferably in a manner which maintains a contiguous RNG sequence.

In one embodiment, a RNG may be assigned or associated with a particular player. Each RNG may have various configurations, as is well known. In one embodiment, each RNG initiates with a seed value and generates a sequence of random numbers. The RNG may be configured to generate numbers in a certain range or ranges. For example, in the case of a card game where cards from a 52 card deck are utilized, the RNG may be configured to generate numerical values between 1 and 52 corresponding to cards in the deck.

The RNG server 40 is preferably configured to implement a plurality of different RNGs. Each RNG may comprise, for example, the separate execution of an instance of software code comprising an RNG. The RNGs could also comprise hardware, such as individual microprocessors.

In a preferred embodiment, each RNG is assigned or associated with a single player. For example, the RNG server 40 may be configured to implement RNG1, RNG2, RNG3 RNGn. A first player P1 may be assigned to RNG1, a second player P2 may be assigned to RNG2 and so on.

In one embodiment, the association of a player P and their RNG may be implemented in association with the player tracking system or server 50, wherein information regarding the player's assigned RNG is associated with their identity.

In one embodiment, the player's assigned RNG is used to determine game outcomes of games presented to the player and played by the player. For example, in one embodiment of the invention, player P1 may wish to play the gaming machine 22 illustrated in FIG. 1. The player may identify themselves at the gaming machine 22, such as by a user ID, player tracking card, biometric identifier or the like. This identification information may be transmitted from the gaming machine 22 to the player tracking server 50. The player tracking server 50 may utilize the information to identify the player. This may include determining the RNG which is assigned to the player. The player tracking server 50 may determine, for example, that RNG1 has been assigned to the player P1. This information may be transmitted back to the gaming machine 22 which in turn utilizes the information to access RNG1 at the RNG server 40.

For example, the gaming machine 22 may be configured to present a video poker game. The gaming machine 22 may communicate with the RNG server 40 to obtain one or more random numbers from RNG1 for use in determining the outcome of the game presented to player P1. This sequence of numbers might be used to determine the identity of cards which are dealt to a player, for example (the sequence of cards thus determining the outcome of the poker hand of the player).

Likewise, the player P1 might wish to play a game via their computer 70 or mobile communication device 80. The player might assess the game server 60 from the computer or mobile device and transmit identification information. The game server 60 may, in similar fashion to the gaming machine 22 described above, determine the identity of the player and obtain random numbers or outcomes via the assigned RNG1 at the RNG server 40 to generate random game outcomes.

Of course, the determination of a player's assigned RNG may be determined in various manners other than by information stored at a player tracking server. For example, a player's identification may be stored in a data table at the RNG server 50, such that a gaming machine 22 may transmit player identification information directly to the RNG server 50 and that server might link the player's RNG to that gaming machine.

In a preferred embodiment, RNGs are uniquely assigned. Thus, a second player P2 may wish to play a second gaming machine (not pictured in FIG. 1). Player P2 may identify them self and player P2's association or assignment to RNG2 may be determined. Thus, random numbers from RNG2 are preferably used to determine the outcomes of the games presented by the gaming machine 22 that player P2 is playing.

In accordance another aspect of the invention, an RNG used to generate data, such as numerical values used to determine game outcomes, may preferably be stopped and restarted at one or more times. Preferably, the RNG is stopped at a particular point of a sequence of data and then later restarted from the next successive point. In one embodiment, this feature is applied to each player's assigned RNG.

As one example of the invention, an RNG may be represented by the following:

$x(\mathbf{0})$=given, $x_{n+1}=P_1x_n+P_2 \pmod N$ n=0, 1, 2, . . . (*), wherein the notation mod N means that the expression on the right of the equation is divided by N, and then replaced with the remainder.

For a particular seed value $x(\mathbf{0})$, this RNG will generate a sequence of numbers. For example, if $x(\mathbf{0})=79$, N=100, $P_1=263$, and $P_2=71$, then:

$$x(1)=79*263+71(\text{mod } 100)=20848(\text{mod } 100)=48,$$

$$x(2)=48*263+71(\text{mod } 100)=12695(\text{mod } 100)=95,$$

$$x(3)=95*263+71(\text{mod } 100)=25056(\text{mod } 100)=56,$$

$$x(4)=56*263+71(\text{mod } 100)=14799(\text{mod } 100)=99,$$

and x(n) continues with the values 8, 75, 96, 68, 36, 39, 28, 35, 76, 59, 88, 15, 16, 79, 48 (then repeating).

In accordance with the invention, this RNG might be started and generate the numbers 48, 95 and 56 to define the outcomes of three successive slot game outcomes (such as where each number represents the stopping position of a set of three physical reels, that stopping position corresponding to a particular set of displayed symbols, and thus a particular slot game outcome).

After three games, the player may wish to cease game play. At that point, the RNG may pause, go idle or the like. When the player wishes to again begin game play, the RNG preferably restarts at the point where the RNG left off. In this case, the next number generated by the RNG would be 99.

In particular, in accordance with a preferred embodiment of the invention, an RNG may be stopped or paused when a particular player ceases game play. The RNG may restart, preferably from the stopping or pausing point (preferably the next data point in the data sequence), when the player wishes to again begin game play.

The RNG may be stopped/paused and restarted based upon various criteria. For example, an RNG may start once a player identifies themselves and a gaming machine "calls" for the first game data or outcome. The RNG may be paused or stopped when a player ceases game play in a session, such as by removing their player tracking card from a gaming machine, logging out or the like, or when another player identifies themselves to begin a session. In one embodiment, the RNG might pause or stop when a predetermined period of game play inactivity occurs.

Figure 3:
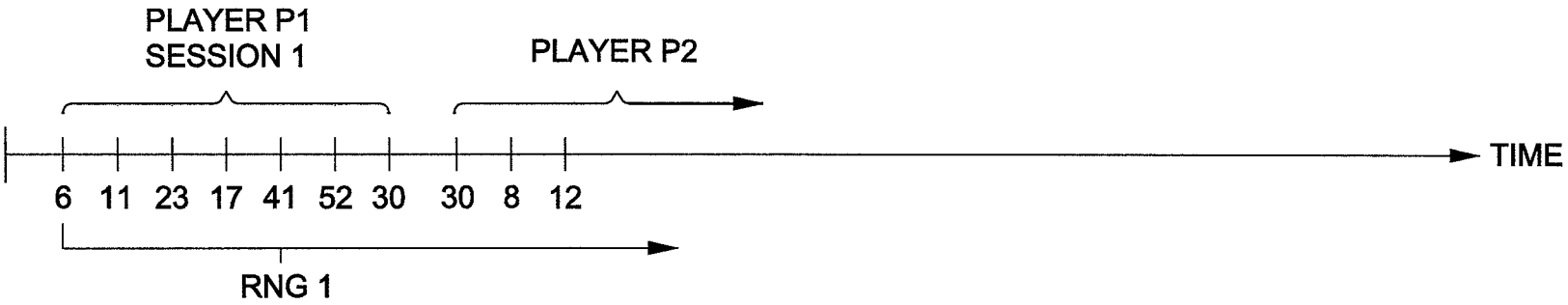
FIG. 3 (PRIOR ART)
FIG. 3 summarily illustrates use of an RNG relative to multiple player game play of a gaming machine in accordance with the prior art.
Figure 4:
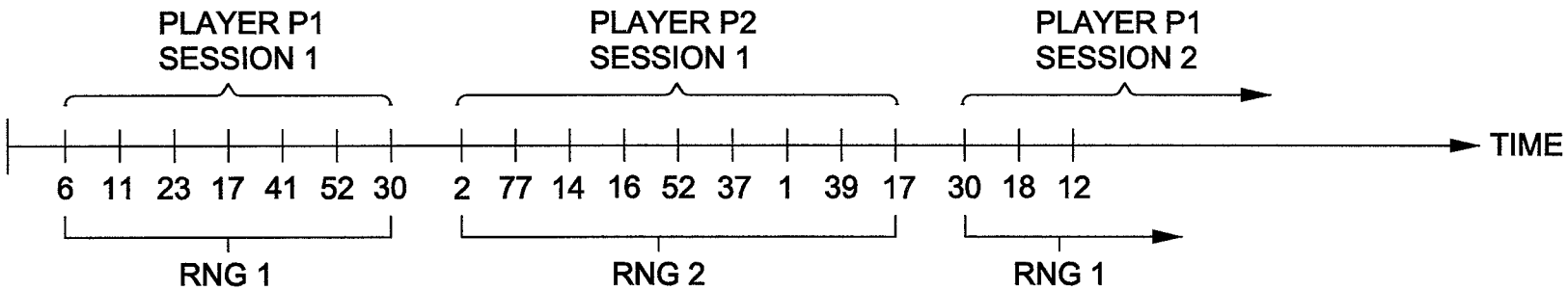
FIG. 4 illustrates operation of a method and system of the invention wherein RNGs are uniquely assigned to two different players.

Various aspects of the invention will be appreciated from FIGS. 3 and 4. FIG. 3 illustrates a configuration of a gaming machine in accordance with the prior art. In this configuration, the gaming machine includes a single RNG which generates a continual sequence of random numbers which are used to determine random game outcomes for all games presented at the gaming machine. A player P1 might play 8 games at the gaming machine, wherein the outcome of the 8 games is determined by 8 randomly generated numbers. In this case, number "30" may correspond to a 7-7-7 slot symbol outcome which is a jackpot winning outcome. As illustrated, player P1 thus received a jackpot winning outcome on the $8^{th}$ game.

After that game, the player P1 may leave the gaming machine, such as to eat or sleep. Player P2 may begin playing the machine. As illustrated, the very next game result was another jackpot winning outcome.

This configuration is actually over-simplified, because in reality in the prior art a gaming machine RNG runs continuously. Thus, after player P1 ceases play, the RNG continues to run and thus generates a sequence of numbers or outcomes before player P2 begins playing the game. Thus, in reality, even player P2 would likely not receive the next randomly generated number "30" in the sequence as illustrated. However, this figure illustrates the concept of how a single RNG is currently used to service the game play by multiple players in accordance with the existing gaming machine art.

FIG. 4 represents a configuration in accordance with the present invention. As illustrated, player P1 begins playing a gaming machine. The gaming machine obtains random game outcome information from the player's assigned RNG1. Assuming the RNG1 generated the same sequence of numbers or outcomes as the gaming machine RNG illustrated in FIG. 2, the player P1 receives a jackpot winning outcome in game 8.

Once again, player P1 may cease play after game 8. At that time, player P2 may begin playing that same gaming machine. In accordance with the invention, the gaming machine obtains random game outcome information from the player's assigned RNG2. In this case, player P2 plays 9 games and then stops playing.

Importantly, player P1 may then again return to the gaming machine and resume play. First, the gaming machine preferably again reverts to the use of RNG1 in order to obtain game results. In addition, in a preferred embodiment of the invention, when the player P1 stopped game play after the first session, the RNG1 stopped or paused. Thus, when the player P1 resumes play, the next game result is another repeated jackpot winning outcome (number "30").

Various additional aspects of the invention and advantages thereof will now be described.

First, it will be appreciated that the player assigned RNG feature and RNG stop/start feature may be applied in various environments other than the system 20 illustrated in FIG. 1. For example, these features could be applied to an individual gaming machine (a stand-alone gaming machine could implement multiple uniquely assigned RNGs) or to only an online or remote access gaming system. In this regard, it is possible for the multiple RNGs to be remotely located at one or more remote devices (such as one or more remote RNG servers 40) or be located locally. It is preferred, however, that the RNGs be located in a manner which permits them to be accessed for use by multiple devices such as multiple different gaming machines, game servers, computers, mobile devices or the like.

In one embodiment, the gaming machines 22 might be configured to execute game code and receive random game outcome information from a remote RNG. However, in other embodiments, the gaming machines 22 might be server-based, such as having a "thin-client" configuration where game information (including outcomes) are run and generated at one or more game servers and the gaming machines 22 essentially comprise presentation devices or kiosks (but where RNG information from a player's assigned RNG is still used to generate such game information for transmission, such as from a game server to a gaming machine or other display device such as a computer or mobile communication device).

It will also be appreciated that the features of the invention need not apply to every player. For example, certain players such as players P1 and P2 might have assigned RNGs, while a third player P3 may not (such as, for example, because players P1 and P2 enrolled in a casino's player tracking program, but the third player P3, did not). In this configuration, the RNG assigned to a particular player may be used when such an assignment exists, but one or more "common" RNG's may be used relative to other player. For example, relative to the gaming machine 22 illustrated in FIG. 1, the gaming machine may include an in-machine RNG, as described above. The gaming machine may utilize that RNG for players (such as player P3 just described) who do not have an assigned RNG. However, the gaming machine 22 may utilize the player's assigned RNG (rather than the common RNG at the machine) when the player has an assigned RNG.

It will be appreciated that the configurations of the RNGs, such as the particular software which implements the RNG and thus the underlying 'math', may vary. In particular, individual RNGs may have various configurations now known or later developed.

It will also be appreciated that the individual RNG data may be used in various manners as is known in the art. For example, particular RNG data may be used to represent entire game outcomes, particular cards or card values, particular slot symbols or the like.

It will also be appreciated that the values which the one or more RNGs generate may vary. For example, the range of RNG values or how those values are utilized may vary. For example, an RNG may generate numerical values in the range of 1-99 or 1-999 or 1-9,999,999,999, 100-10,000, or various other ranges. As indicated, those vales may be used or "mapped" in various manners as part of presenting one or more games.

It will also be appreciated that while the RNGs of the invention preferably generate random data, in accordance with the art, such data may actually be relatively random or pseudo random and not truly random (for example, an RNG of the invention may generate a sequence of numbers which ultimately repeats or which, statistically does not cause each number in a range to be chosen in a statistically equal fashion).

The gaming machines 22, game server 60, remote computer 70, mobile device 80 or other gaming device may be configured to present a wide variety of games. Such games may include video poker, video slots, physical reel slots, blackjack, bingo, keno, and other games now known or later developed. Preferably, the features of the game are most applicable to games where the outcomes are determined wholly or in part by chance and where it is thus preferred that the outcomes be random or partially random (for example, the outcome of a slot game may be entirely random, whereas the outcome of a video poker game having a card draw feature may be partly based upon the player's skill in determining which cards to discard from an initial set of dealt cards).

In a preferred embodiment of the invention, an RNG is assigned to a particular player. Thus, numbers or "outcomes" generated by the RNG which are assigned to that player are not utilized in the play of games by other players. In a preferred embodiment, the RNG which is assigned to a particular player may be used in the presentation and play of games at or via two or more different devices or machines.

This feature has particular advantages over the prior art. In particular, in this arrangement each player's game outcomes are unique and separate. Thus, a first player P1 need not be concerned about stopping game play and leaving a "hot" gaming machine or the like, as described above in the background. In particular, in accordance with the invention, intervening play of such a gaming machine by one or more other players is independent from the sequence or flow of game outcomes for player P1 because the game outcomes for the other players are determined by one or more other RNGs. Thus, a player need not "reserve" a gaming machine or the like in order to protect a particular game flow.

In a further preferred embodiment of the invention, a RNG may be stopped and restarted. An RNG assigned to a particular player may thus be stopped when a player ceases game play and then restarted when the player resumes game play.

In one embodiment, during the time such an RNG is active (i.e. during the time is not stopped or paused), it may continuously generate data. Not all of that data may be used by a gaming machine. For example, during the time a game is being presented, such an RNG might generate hundreds or thousands of values. However, the gaming machine might "call" or use only a few of those values as the gaming machine requires values to play the game. In such a configuration, an RNG might be started and generate a large number of values, only some of which are used during a first gaming session. At the end of that session, the RNG might be stopped or paused. The RNG may then be restarted upon the initiation of a new gaming session, at which time the RNG may again generate values in a continuous manner, not all of which value may be used by the gaming machine during the second session.

In another embodiment, however, a sequence of numbers or game outcomes generate by an RNG might correlate to values needed or used by a gaming machine to present games, i.e. where the RNG generates values which are used in succession or sequentially by the gaming machine. In such a configuration, the RNG might generate a last value in a first gaming session, which last value is used as part of presenting a last game in that first gaming session. The RNG may then pause or stop. When game play resumes, the RNG may again begin generating values, preferably from the very next value in the sequence, and wherein each value generated thereafter in that second session is used sequentially by the gaming machine to present games in that second session (as illustrated in FIG. 4 wherein each generated RNG value is used essentially sequentially by the gaming machine in the presentation of the games).

Relative to this configuration, the RNG data or values might be buffered. For example, upon the initiation of a player's RNG, the RNG might immediately generate a sequence of 100 values. If the player only plays a single game, only 20 of those values might be used. Even though the player's RNG may continue to run, the next instance of game play by that player may preferably begin with the $21^{st}$ data value in the sequence.

In accordance with another aspect of the invention, a gaming machine or device may be shared by two or more players. Preferably, a gaming machine or device may be timed-shared, including in a manner where the gaming machine is unique to each player.

In one embodiment of the invention, two or more players may access and play a gaming machine. While the two or more players might possibly access a gaming machine at the same time, in a preferred embodiment, each player plays the gaming machine at different times.

As one aspect of the invention, one or more players might reserve one or more time periods or intervals for play of a gaming machine. During a reserved time, only the assigned player would be permitted to play the gaming machine. For example, player P1 might reserve the gaming machine 22 illustrated in FIG. 1 during the time period of 1:00 pm to 9:00 pm on Saturday, Aug. 6, 2011. During that time, only player P1 would be permitted to play the gaming machine.

Access to the gaming machine 22 might be controlled in various fashions. First, a reserved gaming machine which is otherwise available for public access might display a reservation notice. This notice may indicate the time or times that gaming machine 22 is reserved and/or that the gaming machine 22 is currently unavailable for play because it is reserved.

In one embodiment, a player having a gaming machine reservation might be required to identify themselves to access the gaming machine during their reserved time. For example, a player P1 might make a reservation at a particular gaming machine or via an associated gaming system. As one example, a casino might operate a reservation website via a server. The website might include a graphical user interface by which players may make gaming machine reservations. The website might display, for example, a list of different gaming machines and available time slots for reservation.

In one embodiment, a player may be required to identify themselves to place a reservation. Once the player has provided identification, the system may store the reservation along with the player's identification information. The system might lock the gaming machine 22 from public use when the reserved time is reached. As indicated, the system might cause the gaming machine 22 to display a "reserved" notice.

In order for the player to access the gaming machine 22, the player may be required to identify themselves. For example, the player might provide identification information such as described above. Such might comprise a player tracking card or the like. Once the player's identity is confirmed against the reservation, then the gaming machine 22 may be unlocked for game play by that player. Of course, if another player attempted to play the gaming machine 22, their identification would not match the reservation and the gaming machine 22 would not permit game play.

In another embodiment, when a player makes a reservation they might simply be issued an access code or the like. The player might then access the gaming machine 22 during the reserved time by providing the access code. In this configuration, a player could reserve a gaming machine without, for example, being a member of a casino's player club or the like.

If a player makes a reservation using a credit or debit card or the like, as detailed below, the player might use that card to identify themselves at the gaming machine.

In one embodiment, a player might be required to pay for a reservation. The cost of a reservation might depend upon various factors including, but not limited to: the particular gaming machine to be reserved (such as a very popular vs. less popular gaming machine), duration of the reservation and/or time of day the reservation. For example, a casino might charge a higher amount for a long duration reservation or for a reservation during peak game play times (such as Friday or Saturday evenings) vs. off-peak times (such as early mornings). Of course, a casino might offer discounts for bulk reservations, players who wager large amounts or the like. A player might be required to make payment for a reservation using monies deposited with the casino (such as from a player's account), via credit card, debit card or the like.

In some embodiments, a casino might offer a player a free reservation or upgraded or a lower cost reservation based upon the player's game play. For example, a player's high level of game play (total wagers during a period, total losses during a period or the like), such as determined by tracking the player's game play via a player tracking system or the like, might result in such awards to the player.

It will be appreciated that these features might be implemented via a system 20 such as illustrated in FIG. 1, wherein the system includes one or more gaming machines 22. However, the features could be implemented at a particular gaming machine. For example, a particular gaming machine 22 could include reservation software, such as to display a reservation window and to control access thereto during reserved times.

In accordance with this aspect of the invention, one or more players might reserve particular time periods or time slots for play of a particular gaming machine. In this manner, the players may "time share" the gaming machine. Of course, during times when the gaming machine is not reserved, a gaming machine might be available for play by any player. Thus, for example, if a player's reservation ends, that player may continue to play unless or until another player's reservation goes into effect. For example, if a player P1's reservation lasts from 3-5 pm and a second player P2's reservation does not start until 6 pm, player P1 might continue to play the gaming machine during the "public" period from 5-6 pm. Of course, during a "public" or unreserved period, the player ceases game play and leaves the gaming machine, another player may freely access the gaming machine.

In accordance with a preferred embodiment of the invention, the time-share feature is enabled in a manner that a single gaming machine is unique or dedicated to a player. In one embodiment, this feature is implemented by the player assigned RNG feature described herein. In particular, in a preferred embodiment, during a reserved time period, a player's play of a gaming machine is implemented by the player's uniquely assigned RNG.

This concept may be appreciated from FIG. 4. As one example of the invention, player P1 might reserve a first gaming machine GM1 during the time slot of 5-7 pm on a Saturday. During that time period or session, player P1 might play a number of games at the gaming machine GM1. Preferably, the gaming machine GM1 implements those games via the player's uniquely assigned RNG1.

A second player P2 might reserve the time slot 7-9 pm on the same Saturday. As a result of player P2s reservation following player P1's reservation, player P1 must stop game play at the gaming machine GM1 at 7 pm. Player P2 may then access the same gaming machine GM1 during the time period of 7-9 pm. During that time or session, player P2 might play a number of games at the gaming machine GM1. Preferably, the gaming machine GM1 implements those games via the player's uniquely assigned RNG2.

It will now be appreciated that the gaming machine GM1 essentially acts as a dedicated or unique device to each player, even though it is being shared by two or more players. In particular, by using the RNG feature described herein, a player's play of a gaming machine is unique to that player (other players' play of the gaming machine does not impact or effect the game outcomes or the like to that player).

Of course, this feature of the invention may be implemented in various manners. For example, a player might be prevented from making two or more reservations during the same time period (such as at two different gaming machines). A player might also be prevented from making excessive reservations, such as reservations totaling more than a certain aggregate time during a single day, during a week or other time period.

This feature of the invention may be applied to various gaming machines or devices. Such may include a gaming machine 22 such as described above, but may include other configurations of devices, including table-type games or the like. For example, a player might be permitted to reserve a spot at a multi-player gaming machine, device, table or other system.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A gaming system comprising at least one gaming machine configured to present a game to at least a first player and a second player, the improvement comprising:

a first random number generator configured to generate first data, said first random number generator assigned to said first player; and a second random number generator configured to generate second data, said second random number generator assigned to said second player, said gaming machine utilizing said first data and not said second data when presenting games to said first player and said gaming machine utilizing said second data and not said first data when presenting games to said second player.

2. The gaming system in accordance with claim 1 wherein said first random number generator and second random number generator are implemented by a server which is remote from said at least one gaming machine.

3. The gaming system in accordance with claim 1 wherein said gaming machine comprises a housing, a controller, at least one player input device, a wager accepting device and at least one display device and is configured to present one or more wagering games.

4. The gaming system in accordance with claim 3 wherein said wagering games are selected from the group consisting of: a poker game, a blackjack game, a slot game, a keno game and a bingo game.

5. The gaming system in accordance with claim 1 wherein said first and second game data comprise numerical values.

6. The gaming system in accordance with claim 1 wherein said at least one gaming machine comprises a game server.

7. The gaming system in accordance with claim 6 wherein said game server is configured to present a game via a remote computer or mobile communication device.

8. The gaming system in accordance with claim 1 wherein said gaming machine utilizes said first random number generator during a first time period comprising a reserved period of game play for said first player.

9. The gaming system in accordance with claim 8 wherein said gaming machine utilizes said second random number generator during a second time period comprising a reserved period of game play for said second player.

10. A method of presenting games to at least a first player and a second player of at least one gaming machine comprising:

assigning a first random number generator to said first player and a second random number generator to said second player;

determining the identity of a player of said at least one gaming machine;

if said player is identified to be said first player, utilizing first data generated by said first random number generator and not said second data generated by said second random number generator to present one or more games to said first player at said at least one gaming machine; and if said player is identified to be said second player, utilizing said second data generated by said second random number generator and not said first data generated by said first random number generator to present one or more games to said second player at said at least one gaming machine.

11. The method in accordance with claim 10 further comprising the step of receiving player identification information.

12. The method in accordance with claim 11 wherein said receiving step comprises reading information associated with a player provided media.

13. The method in accordance with claim 10 wherein said first random number generator and second random number generator are implemented by a server which is remote from said at least one gaming machine.

14. The method in accordance with claim 10 further comprising the step of reserving said at least one gaming machine for play only by said first player or said second player during at least one reserved time period.

15. The method in accordance with claim 14 further comprising the step of using said identify of said player during said at least one reserved time period to confirm access of said player to said gaming machine.

16. A method of presenting games to a player of a gaming machine comprising:

starting a random number generator which generates a sequence of data;

utilizing data from said random number generator to present a first number of games to said player at said gaming machine;

stopping said random number generator when said player ceases game play;

restarting said random number generator when said player re-initiates game play; and utilizing data from said random number generator to present a second number of games to said player at said gaming machine.

17. The method in accordance with claim 16 wherein said random number generator stops at a first point in said sequence of data and restarts at the successive point in said sequence of data.

18. The method in accordance with claim 16 wherein said data comprises numerical values.

19. A method of presenting games to at least a first player and a second player of a gaming machine comprising:

assigning a first random number generator to said first player and a second random number generator to said second player;

during a first time period of game play reserved by said first player:

confirming the identity of said first player of said gaming machine; and utilizing first data generated by said first random number generator to present one or more games to said first player at said gaming machine; and during a second time period of game play reserved by said second player:

confirming the identity of said second player of said gaming machine; and utilizing said second data generated by said second random number generator to present one or more games to said second player at said gaming machine.

* * * * *